US009360260B2

(12) United States Patent
Van Den Kerkhof et al.

(10) Patent No.: US 9,360,260 B2
(45) Date of Patent: Jun. 7, 2016

(54) HEAT EXCHANGE LAMINATE

(71) Applicant: OCÉ-TECHNOLOGIES B.V., Venlo (NL)

(72) Inventors: Franciscus M. G. Van Den Kerkhof, Maasbree (NL); Joseph A. Schulkes, Asten (NL); Gerrit P. J. Du Buf, Velden (NL); Margo H. J. Beurskens-Linssen, Steyl (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/868,099

(22) Filed: Sep. 28, 2015

(65) Prior Publication Data

US 2016/0018172 A1 Jan. 21, 2016

Related U.S. Application Data

(63) Continuation of application No. PCT/EP2014/056280, filed on Mar. 28, 2014.

(30) Foreign Application Priority Data

Mar. 29, 2013 (EP) ..... 13161847

(51) Int. Cl.
*B41J 29/377* (2006.01)
*F28F 21/02* (2006.01)
(Continued)

(52) U.S. Cl.
CPC ..... *F28F 21/02* (2013.01); *B41J 29/377* (2013.01); *F28F 13/185* (2013.01);
(Continued)

(58) Field of Classification Search
CPC ..... B41J 11/04; B41J 11/057; B41J 11/08; B41J 11/02; B41J 11/06; B41J 15/02; B41J 15/044; B41J 29/02; B41J 29/00; B41J 29/026; B41J 29/377
USPC ..... 347/220–222, 197, 198, 104, 171, 14, 347/17, 16, 101, 106, 223, 228
See application file for complete search history.

(56) References Cited

U.S. PATENT DOCUMENTS 7,819,516 B2 10/2010 Groenenberg et al.

FOREIGN PATENT DOCUMENTS

EP 1 875 790 A0 1/2008
WO WO 2006/132695 A2 12/2006
(Continued)

OTHER PUBLICATIONS

International Search Report, issued in PCT/EP2014/056280, dated Jul. 9, 2014.
(Continued)

*Primary Examiner* — Kristal Feggins
(74) *Attorney, Agent, or Firm* — Birch, Stewart, Kolasch & Birch, LLP

(57) ABSTRACT

The invention relates to a heat exchange laminate for use as a heat exchange member in a heat exchange unit, comprising a base layer extending substantially planar, said base layer being bilaterally coated with an electrical conductive contact layer. The contact layer comprises a high molecular weight polyethylene and a carbon black. The invention further relates to the use of the heat exchange laminate and to a heat exchange unit and a printing system comprising such a heat exchange laminate.

19 Claims, 5 Drawing Sheets

(51) Int. Cl.

| | |
|---|---|
| ***G03G 15/16*** | (2006.01) |
| ***G03G 15/00*** | (2006.01) |
| ***F28F 13/18*** | (2006.01) |
| ***F28F 21/06*** | (2006.01) |
| *G03G 21/20* | (2006.01) |

(52) U.S. Cl.
CPC ..... *F28F 21/065* (2013.01); *G03G 15/1695* (2013.01); *G03G 15/6558* (2013.01); *G03G 15/6573* (2013.01); *G03G 21/20* (2013.01)

(56) References Cited

FOREIGN PATENT DOCUMENTS

| | | | |
|---|---|---|---|
| WO | WO 2007/122033 | A1 | 11/2007 |
| WO | WO 2007/122198 | A1 | 11/2007 |

OTHER PUBLICATIONS

Written Opinion of the International Searching Authority, issued in PCT/EP2014/056280, dated Jul. 9, 2014.

HEAT EXCHANGE LAMINATE

This application is a Continuation of PCT International Application No. PCT/EP2014/056280 filed on Mar. 28, 2014, which claims priority under 35 U.S.C. §119(a) to Patent Application No. 13161847.2 filed in Europe on Mar. 29, 2013, all of which are hereby expressly incorporated by reference into the present application.

FIELD OF THE INVENTION

The invention relates to a heat exchange laminate for use as a heat exchange member in a heat exchange unit. The invention further relates to the use of the heat exchange laminate and to a heat exchange unit and a printing system comprising such a heat exchange laminate.

BACKGROUND ART

A heat exchange member for printing systems is known from U.S. Pat. No. 7,819,516. This printing system comprises a heat exchange unit wherein a heat exchange laminate is used, comprising a base layer extending substantially planar, said base layer being bilaterally coated with a graphite foil. A receiving medium is fed through the heat exchange unit along the heat exchange laminate and thereby is in moving contact with the outer surface of the graphite foil. It has been found that the outer surface of the graphite foil is slowly worn during use of the heat exchange unit by the moving receiving medium. As a result the durability of the heat exchange unit is restricted.

SUMMARY OF THE INVENTION

It is an object of the present invention to further increase the durability of the heat exchange member. To this end a heat exchange laminate for use as a heat exchange member in a heat exchange unit has been provided, comprising a base layer extending substantially planar, said base layer being bilaterally coated with an electrical conductive contact layer, which comprises a high molecular weight polyethylene polymer and a carbon black.

A planar base layer as part of the heat exchange laminate results in an efficient contact with thermal energy donating or receiving media. In particular flat media, such as sheets of print media, are in operation commonly transported in flat transport paths along the heat exchange laminate. The base layer is constructed such that it comprises enough strength and the desired stiffness to act efficiently in a heat exchange unit. These properties may be chosen in dependence of the used thermal energy donating and receiving media, both the properties in the plane of the base layer as well as out of the plane.

The surfaces of energy donating and receiving media are not to be defaced by friction or surface roughness of the heat exchange laminate. The bilateral coating of the base layer with a contact layer is chosen such that friction and roughness of the heat exchange laminate surface are minimised, such that the energy receiving and donating media are not damaged. The media which are sliding against and along the media to exchange thermal energy may comprise marking material at a relatively high temperature. This means that the marking material may be quite sensitive for damages when it passes along the heat exchange laminate. A smooth surface of the heat exchange laminate with very little friction is therefore an important feature for application in such systems.

The heat exchange laminate of the base layer having a contact layer on both sides of the base layer is electrical conductive. This reduces the risk of blocking in a system wherein such a laminate is applied. Blocking is the occurrence of a barrier in the transport path along the heat exchange laminate by the energy receiving or the donating media. Electrical isolating top surfaces of the heat exchange laminate may result in a static electrical charging of the thermal energy receiving and donating media and in a static electrical charging of the contact layer. A statically charged media may demonstrate sticking e.g. to the heat exchange laminate, to transport rollers or to other energy receiving or donating media.

Each of the contact layers on both sides of the base layer comprises a high molecular weight polyethylene. The polyethylene provides an inert surface having a relatively low surface energy. As used herein a high molecular weight polyethylene has a weight average molecular weight $M_w$ of at least $5\times10^5$ g/mol. The high molecular weight polyethylene is present at the outer surface of the contact layer and thereby reduces the wear of the outer surface.

Furthermore each of the contact layers on both sides of the base layer comprises a carbon black. The carbon black is suitably applied to provide an electrical conductive property to the contact layer. The carbon black is present at the outer surface of the contact layer. As a result tribo-electric charging of the outer surface of the contact layer is reduced and/or tribo-electric charge is removed from the outer surface, Additionally tribo-electric charging of a thermal energy donating or receiving media in the heat exchange unit is reduced and/or tribo-electric charge is removed from the contacting surface of the thermal energy donating or receiving media. Preferably the carbon black is a highly conductive carbon black comprising particles having a specific surface area of at least 100 square meters per gram.

In an embodiment of the heat exchange laminate according to the present invention, the carbon black is provided in an amount of at least 3 wt % based on the total weight of the contact layer, more preferably in an amount of at least 4 wt % based on the total weight of the contact layer, wherein the carbon black encloses polyethylene domains. It has been found that at least 3 wt % of carbon black is effective in reducing the tribo-electric charging of the contact layer. When at least 3 wt % of carbon black is used polyethylene domains may be formed which are enclosed by the carbon black. The carbon black forms conductive paths in the contact layer for removing tribo-electric charge from the outer surface of the contact layer.

Furthermore when using at least 4 wt % of carbon black in the contact layer it has been found to be more easy to manufacture a contact layer, which reduces the tribo-electric charging of the contact layer.

In an embodiment of the heat exchange laminate according to the present invention, the polyethylene domains have a number average domain size of at most 50 microns. The number average domain size of the polyethylene domains is statistically determined based on at least 1 $mm^2$ of outer surface of the contact layer and is averaged over the number of polyethylene domains measured. It has been found that a number average domain size of at most 50 microns improves the reduction in tribo-electric charging of the contact layer.

In an embodiment of the heat exchange laminate according to the present invention, the polyethylene domains of the contact layer are provided by a polyethylene powder having an volume average particle size of about 60 micron or smaller. For preparing the contact layers a mixture is made of polyethylene powder and carbon black powder. It has been found that a contact layer having small polyethylene domains (i.e. having a number average domain size of at most 50 microns) can easily be formed using a polyethylene powder having an volume average particle size of about 60 micron or smaller.

In an embodiment of the heat exchange laminate according to the present invention, the polyethylene domains in the contact layer are provided by a polyethylene powder having an volume average particle size of about 30 micron or smaller. It has been found that a contact layer having very small polyethylene domains (i.e. having a number average domain size of at most 30 microns) can easily be formed using a polyethylene powder having an volume average particle size of about 30 micron or smaller.

In an embodiment of the heat exchange laminate according to the present invention, the polyethylene has a weight average molecular weight $M_w$ of at least $4\times10^6$ g/mol, more preferably of at least $9\times10^6$ g/mol. When the polyethylene has a weight average molecular weight $M_w$ of at least $4\times10^6$ g/mol the wear of the outer surface of the contact layer is significantly reduced. When the polyethylene has a weight average molecular weight $M_w$ of at least $9\times10^6$ g/mol in applications for moving print media substantially no wear is observed of the contact layers of the heat exchange laminate.

In an embodiment of the heat exchange laminate according to the present invention, the electrical conductive non-metallic contact layer has a thickness of at most 200 microns. The contact layer has a relatively low thermal conductivity due to the high molecular weight polyethylene. By restricting the thickness of the contact layer the thermal conductivity of the heat exchange laminates is improved. More preferably the thickness of the contact layer is about 100 microns. Restricting the thickness of the contact layer to about 100 microns provides a minimal loss of heat transfer efficiency of the heat exchange laminate.

In an embodiment of the heat exchange laminate according to the present invention, the base layer is a metallic sheet. The base layer being a metallic sheet provides a relatively high thermal conductivity. Furthermore the base layer being a metallic sheet provides an electrical conductive path for removing the tribo-electric charge from the contact layer.

In an embodiment of the heat exchange laminate according to the present invention, the metallic sheet comprises an iron-nickel-alloy. Preferably the metallic sheet comprises substantially 35% nickel. The iron-nickel-alloy with a nickel content of approximately 34-37%, preferably 35-36% nickel, has a substantially low coefficient of thermal expansion. This applies in particular to the face centred cubic crystal-formation of the iron-nickel-alloy. The use of this metallic alloy as a base layer in the heat exchange laminate results in a thermally stable base form. A base layer constructed from a material with a low Young's modulus and/or a low thermal expansion coefficient reduces the risk of wrinkling due to a high temperature gradient over the heat exchange laminate. In particular in applications with a cross-flow heat exchange concept, one end of the laminate has a higher temperature, e.g. the end near the print engine, or fuse station of a printer, than the other end in operation, e.g. the end near the paper trays and/or the delivery station. Even more, one side of the laminate, in particular the side of the transport path of the thermal energy receiving media is colder than the opposite side of the laminate, in particular the side of the transport path of the thermal energy donor. Thus, a relatively high temperature gradient in both the direction of thickness of the laminate as well as in the plane of the laminate may in operation result in a large gradient of thermal expansion of the laminate, potentially resulting in wrinkling the laminate.

In an embodiment of the heat exchange laminate according to the present invention, the base layer has a linear thermal expansion coefficient $\alpha$ smaller than $2\times10^{-6}$ m/m·K. This results in a low risk of wrinkling the laminate when exposed to a large thermal gradient and therefore results in a higher certainty in the operation of the heat exchange unit.

In another aspect of the invention a use of the heat exchange laminate according to the present invention in a heat exchange unit, the heat exchange unit being configured for providing a sliding contact between an energy donating element and providing a first contact layer of the heat exchange laminate and a sliding contact between an energy receiving element and a second contact layer of the heat exchange laminate. The heat exchange laminate according to the present invention is especially advantageous when a tribo-electric charging may occur of the first contact layer and of the second contact layer due to a sliding contact with either an energy donating element or an energy receiving element. The energy donating element and the energy receiving element may be a sheet, may be a web, may be a print media or any other moving planar element.

In an embodiment of the use of the heat exchange laminate according to the present invention, wherein the heat exchange unit is a counter-flow heat exchange unit. As used herein in a counter-flow heat exchange unit the sliding contact between the energy donating element and the first contact layer of the heat exchange laminate has a first direction which is opposite to a second direction of the sliding contact between the energy receiving element and the second contact layer of the heat exchange laminate.

In an embodiment of the use of the heat exchange laminate according to the present invention, wherein the heat exchange unit is provided in a printing system for cooling a print media from a print engine and heating a print media towards a print engine, wherein each of the print media is in moving contact with one of the first and second contact layers of the heat exchange laminate. Print media may have various compositions and may have various coatings on the surface. Especially the outer surface of the print media is commonly varied in order to achieve a suitable print quality in a printing system. The composition and roughness of the contact surface of the print media influences the tribo-electric charging of the contact layer of the heat exchange laminate and of the print media itself. It has been found that the heat exchange laminate according to the present invention reduces the tribo-electric charging for a broad variety of coated and uncoated print media.

In another aspect of the invention a heat exchange unit is provided, comprising a heat exchange region, a first print media transport path configured for transporting in operation a first print medium from a print media supply through the heat exchange region to a print engine and a second print media transport path configured for transporting in operation a second print medium from the print engine through the heat exchange region, the heat exchange unit further comprising a stationary heat exchange member, having a first side facing said first print media transport path and a second opposite side facing said second print media transport path, in operation the second print medium is at an elevated temperature with respect to the first print medium and wherein the first and second print medium have a heat exchange contact in the heat exchange region, wherein the stationary heat exchange member is a heat exchange laminate according to the present invention.

In another aspect of the invention a printing system is provided, comprising a print media supply, a print engine for applying marking material to a print media and a heat exchange unit according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF THE DRAWINGS

Figure 1:
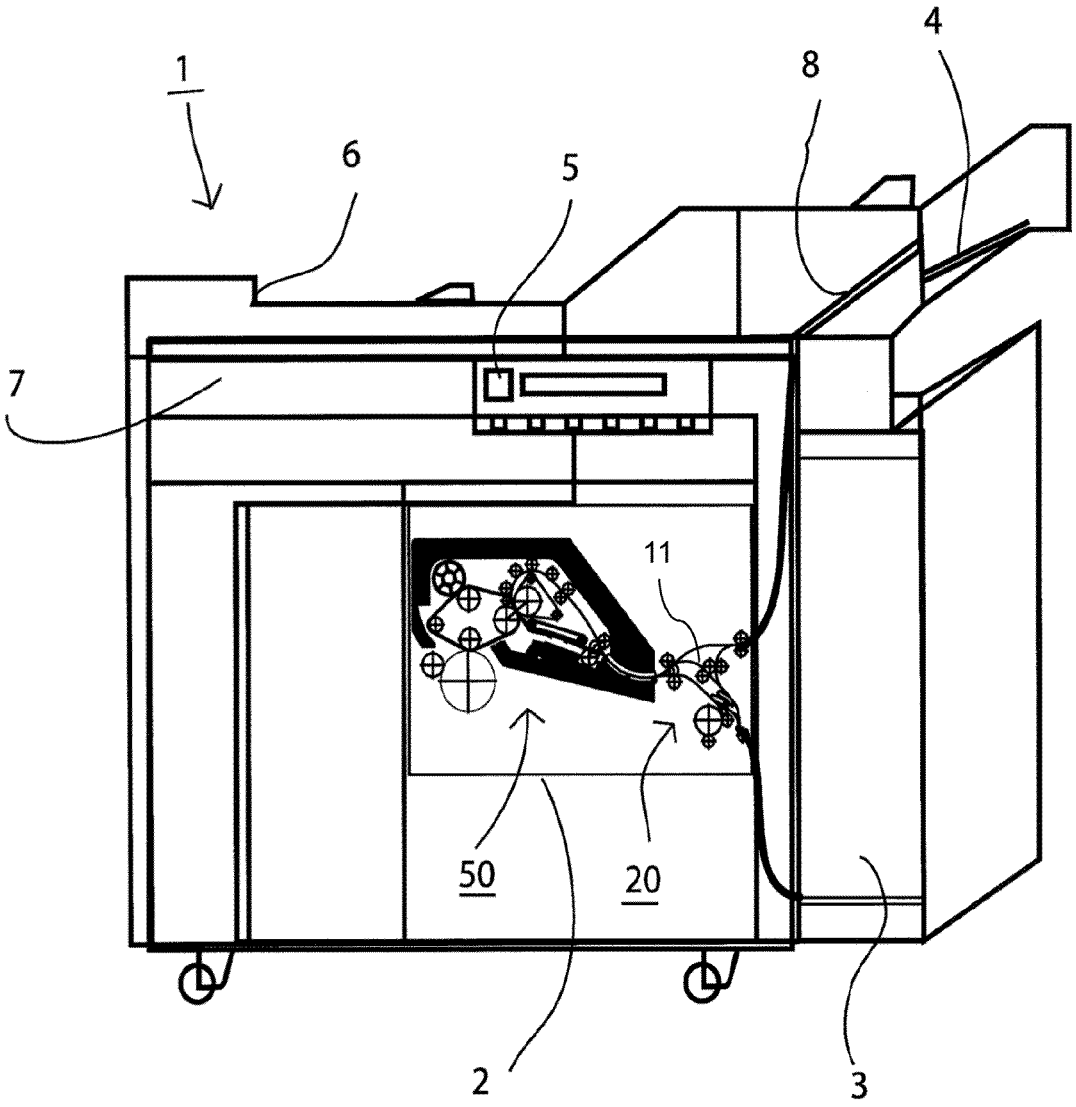
FIG. 1 is a schematic view showing a printing system comprising a heat exchange unit comprising a heat exchange laminate according to an embodiment of the present invention.

The present invention will now be described with reference to the accompanying drawings, wherein the same reference numerals have been used to identify the same or similar elements throughout the several views.

FIG. 1 shows a schematic view showing a printing system comprising a heat exchange unit comprising a heat exchange laminate according to an embodiment of the present invention. The printing system 1 having an engine 2 in which the paper is fed into from a supply 3, preconditioned and printed with a printing process 50 and fed to a take-out area from which an operator can take-out the printed media. The printing system 1 delivers marking material onto the print media in an image-wise fashion. This image can be fed e.g. by a computer via a wired or wireless network connection (not shown) or by means of a scanner 7. The scanner 7 scans an image that is fed into the automatic document feeder 6 and delivers the digitised image to the printing controller (not shown). This controller translates the digital image information into control signals that enable the controller to control the marking units that deliver marking material onto an intermediate member. A preheated print medium is fed along the intermediate member, from which the image-wise marking material image is transferred onto the print medium. This marking material image is fused on the print medium in a fuse step under elevated pressure and temperatures. The image bearing print medium is cooled down to a lower temperature before the print medium is delivered to the take-out area 4. A user-interface 5 enables the operator to program the print job properties and preferences such as the choice for the print medium, print medium orientation and finishing options. The printing system 1 has a plurality of finishing options such as stacking, saddle stitching and stapling. The finishing unit 8 executes these finishing operations when selected. It will be clear for the person skilled in the art that other image forming processes wherein an image of marking material is transferred onto a print media, possibly via one or more intermediate members, e.g. electro(photo)graphic, magnetographic, inkjet, and direct imaging processes are also applicable. The print media 11 that are delivered from the print process 50 are at an elevated temperature because of heating in the print process 50 and the heating in the fuse step. The heat exchange unit according to the present invention uses the thermal energy of these outgoing print media for the preheating of cold media that have to be preheated before entering the print process 50. The outgoing printed media 11 are transported through a heat exchange zone in the heat exchange unit 20.

Figure 2:
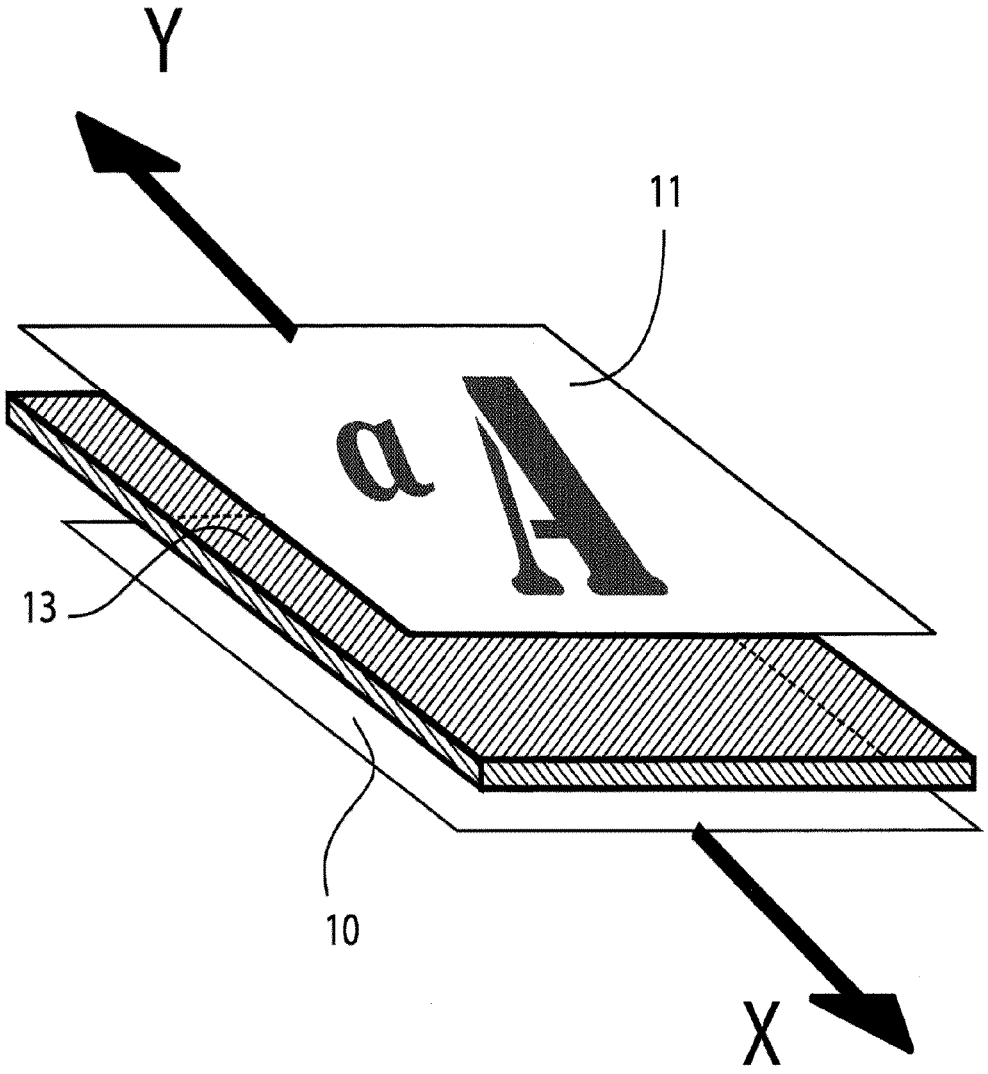
FIG. 2 is a schematic view of the heat exchange process according to an embodiment of the present invention.

FIG. 2 shows a schematic view of this principle. A print medium 10 that is separated from a supply unit 3 is transported to the print process 50 in the direction marked with arrow X. The thermal energy of the printed media 11 that originates from the print process and the fuse step is donated to the cold print media 10 through a thermal intermediate heat exchange member 13. While cooling the printed medium 11 down to an acceptable temperature in which the marking material is hardened and therefore less sensitive to smearing, the printed medium 11 is transported in the direction marked with arrow Y towards the take-out area 4 of the printing system 1.

Figure 3:
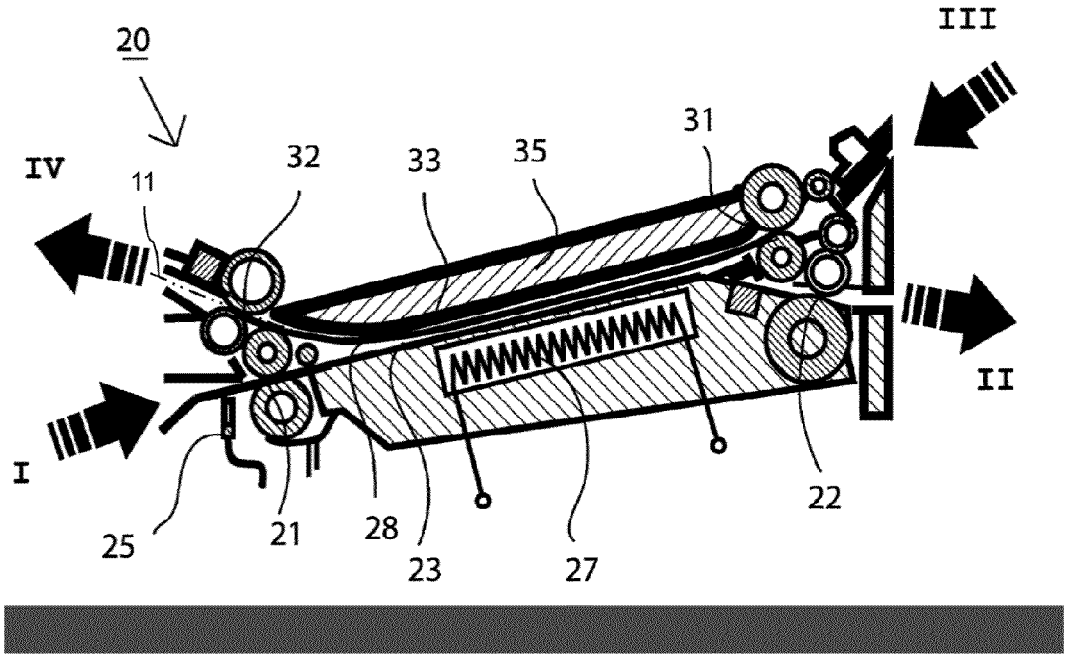
FIG. 3 is a schematic view of a heat exchange unit comprising a heat exchange laminate according to an embodiment of the present invention.

FIG. 3 is a schematic view of a heat exchange unit comprising a heat exchange laminate according to an embodiment of the present invention. A print medium is separated from a supply unit 3 and fed into the first print media transport path 23 of the heat exchange unit 20 in the direction of arrow I. This entry into the heat exchange unit is registered by sensor 25. The print medium is moved into pinch 21, which pushes the print medium through the first print media transport path 23 towards pinch 22. Pinch 22 draws the print medium from area 23 towards the print process (not shown) in the direction of arrow II. Inside the print process the print medium is pre-heated by an electric pre-heater (not shown) to facilitate the image-wise application of marking material which is fused into the print medium under elevated pressure and temperature. Both the application of the marking material and the fusing of the marking material onto the print medium increase the temperature of the print medium. The print medium at elevated temperature is then ejected from the print process and fed into the second print media transport path 33 of the heat exchange unit in the direction of arrow III. Pinch 31 pushes the print media from the print process towards pinch 32. While the print media at elevated temperature is transported through the second print media transport path 33 a second print media is fed into the first print media transport path 23. As the first and second print media transport paths 23, 33 are having a mutually heat exchange contact, the first print media at elevated temperature in the second print media transport path donates its thermal energy partly to the second print media in the first print media transport path 23 which receives the thermal energy and heats up. Because the first print medium donates thermal energy to the second print medium, the pre-heater of the print process can lower its thermal dissipation.

In case of the absence of a print medium at an elevated temperature, e.g. at system start-up or after an interruption of print-activity, the heater element 27 can correct for the absence of the extra thermal energy as long as no print media at elevated temperature is available.

To improve the exchange of thermal energy between print media at elevated temperature in the second print media transport path 33 and the cold media in the first print media transport path 23 a pressing member 35 applies a pressure on the print media at elevated temperature such that the heat exchange efficiency increases. This pressure is high enough to increase the heat exchange efficiency and low enough not to disturb the passage of the print media too much.

Pressing member 35 is a foam layer that applies approximately 20-200 Pa of pressure on the print media. The heat exchange member being stationary, i.e. the member does not move relative to the print media in the print media transport path, increases the efficiency of the heat exchange.

Print media 11 that are transported through the paper paths 23, 33 are initially pushed respectively by pinches 21 and 31 until the print media are fed into drawing pinches 22 and 32. These drawing pinches 22 and 32 draw the print media out of the print media transport paths 23 and 33. Because the print media inside of the print media transport paths 23, 33 are influenced by a certain amount of friction this drawing out of the print media 11 will put stress of the print media when drawn out. To decrease the risk of smearing and cross-pollution of marking material from one print medium onto the other a thin and flexible heat exchange laminate 28 is applied in between said first and second print media transport paths 23, 33.

This thin flexible heat exchange laminate 28 is very smooth such that the print media are not obstructed while they are transported through the print media transport paths 23, 33.

The heat exchange laminate 28 is preferably resistant to wear and has a low sliding resistance. The heat exchange laminate 28 according to the present invention comprises an outer surface which is constituted by an ultra high molecular weight polyethylene and a carbon black. The weight average molecular weight of the polyethylene is preferably larger than $4\times10^6$ g/mol even more preferably at least $9\times10^6$ g/mol. The molecular weight of the polyethylene is determined based on the intrinsic viscosity [η] of the polyethylene and derived from the intrinsic viscosity using the Margolies equation [$M_w=5.37\times10^4\times[\eta]^{1.49}$]. The high molecular weight of the polyethylene provides a high degree of crystallinity of the polymer (i.e. more than 50%).

As a result the polyethylene is highly resistant to wear. Furthermore the polyethylene provides a surface having a low surface roughness and a low Coefficient of Friction.

Figure 4A:
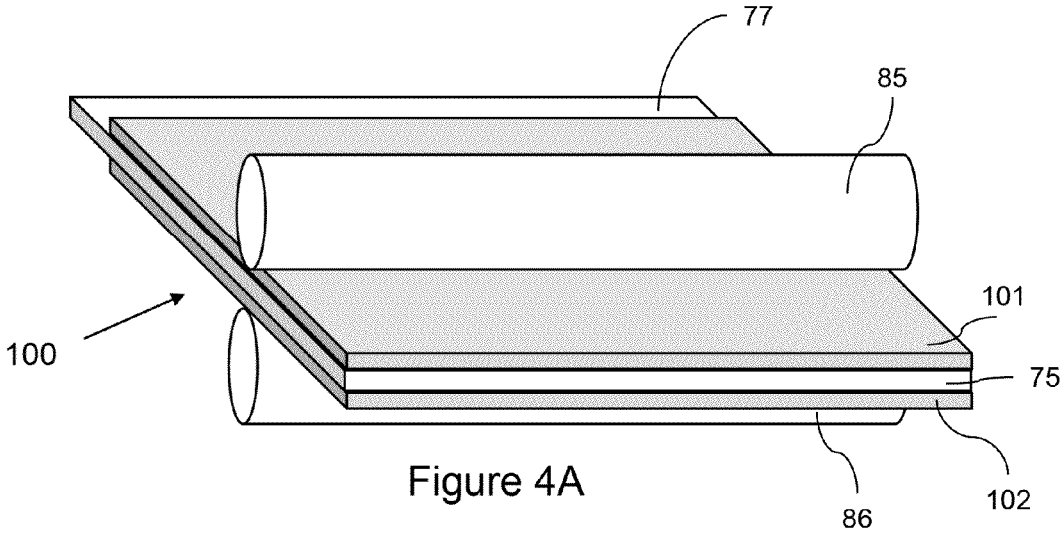
FIG. 4A shows a schematic view of a method of producing a heat exchange laminate according to an embodiment of the invention.

FIG. 4A shows a schematic view of a method of producing a heat exchange laminate according to an embodiment of the invention. First a base layer 75 is fabricated. To this end a sheet of iron-nickel alloy, comprising substantially 35% nickel is cut into shape, such that the resulting laminate 100 will fit into a heat exchange unit for a printing system. The iron-nickel alloy has a high thermal conductivity (14 W/m·K) and a relatively low coefficient of thermal expansion ($1.8\times10^{-6}$ m/m·K). A coefficient of Linear Thermal Expansion (CLTE) is determined according to the method of ISO 11359-1,-2.

The heat exchange laminate 100 is formed by bonding to both sides of the base layer 75 a contact layer 101, 102 of a electrical conductive UHMW PE foil. The preparation of a suitable electrical conductive UHMW PE foil is described in the examples of preparation. The bonding is carried out by forming a bonding layer using a glue substance. The bonding layer has a thickness in the order of 10 to 50 microns. During bonding a bonding pressure is provided on the base layer 75 and contact layers 101, 102, for example by a pinch formed by rollers 85 and 86. Alternatively a bonding pressure may be provided by two parallel plates which contact the contact layers 101, 102.

In an embodiment the bonding layer is provided by using electrical conductive glue which has a low volume resistivity (i.e. lower than 100 ohm·cm), such as Eccocoat CE 7512, which is provided by Henkel Electronic Materials. The curing of the bonding layer is carried out at approximately 80° C.

In an alternative embodiment the bonding layer is provided by using a non-conductive glue formulation, such as UHU Endfest 300, which is a solvent-free 2-component epoxy resin. The curing of the bonding layer is carried out at approximately 70° C. In this embodiment of the heat exchange laminate an electrical conductive bridge is formed between the contact layer 101, 102 of the UHMW PE foil and the base layer 75 by providing additional bonding spots by using a glue comprising Ag particles.

Figure 4B:
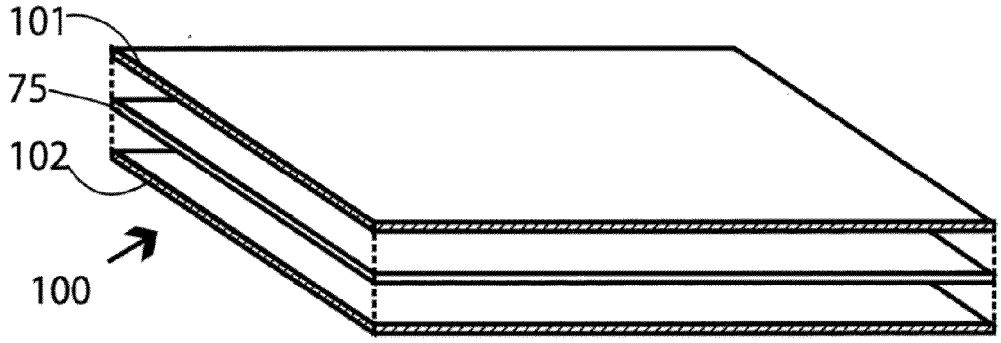
FIG. 4B shows a schematic exploded view of the heat exchange laminate.

FIG. 4B shows a schematic exploded view of the heat exchange laminate 100. Base layer 75 is bilaterally coated with and bonded to two contact layers of electrical conductive UHMW PE 101, 102. The base layer 75 is a layer of a 35% nickel-iron alloy.

This alloy has a very low coefficient of thermal expansion. Therefore a temperature gradient over the base layer 75, or heat exchange laminate 100 e.g. as a result of hot print media at a first end and cold print media at the opposite side, does result in large expansion differences. Therefore the heat exchange laminate will remain its planar shape and does not wrinkle due to thermal differences over its surface during operation.

To improve the thermal behaviour of the heat exchange laminate 28 during the heat exchange between a first and a second print medium the heat exchange laminate 28 is constructed very thin, such that the heating of the heat exchange laminate 28 itself does not obstruct the heat exchange between the print media. Preferably the base layer has a thickness of about 100 microns and each of the contact layers have a thickness of about 100 microns or smaller. Therefore the heat capacity and thermal resistivity of the heat exchange laminate are adapted to exchange the heat between the first and second print media.

In order to restrict tribo-electric static charging of the print media the electro-conductive properties of the heat exchange laminate 28 are important. In Table 1 the properties of a variety of tested UHMW-PE foils used as contact layer in the heat exchange laminate are shown:

TABLE 1

Properties of UHMW-PE foils.

| Contact layer | Ra [um] | Rz [um] | Pt [um] | Volume resistivity [kOhm] | Surface resistivity [kOhm] | Carbon black [wt %] |
|---|---|---|---|---|---|---|
| No. 440B | 0.19 | 2.5 | 8.0 | 50-100 | | 2.8 |
| PG5415B | 0.17 | 1.4 | 4.0 | 2000-3000 | | 4.5(1) |

TABLE 1-continued

Properties of UHMW-PE foils.

| Contact layer | Ra [um] | Rz [um] | Pt [um] | Volume resistivity [kOhm] | Surface resistivity [kOhm] | Carbon black [wt %] |
|---|---|---|---|---|---|---|
| PG5400BC | 0.18-0.35 | 1.7-2.7 | 5.5-12 | 100-400 | $4 \times 10^4$ | 3.2(2) or 4.0(2) |
| PG5422BC | 0.6 | 5.1 | 10 | 100-300 | | 5.5(2) |
| PG5426BC | 0.29 | 4.0 | 10 | 20-200 | $4 \times 10^4$ | 6.5(2) |

(1)Flammruss 101 (Orion engineered carbons), having a BET surface area of appr. 20 $m^2/g$
(2)Printex L6 (Orion engineered carbons), having a BET surface area of appr. 250 $m^2/g$ The UHMW-PE Foils PG5415B, PG5400BC, PG5422BC and PG5426BC are all provided by PerLaTech Gmbh. The UHMW-PE Foil No. 440B is provided by Nitto Denko.

The roughness Ra, Rz and Pt are measured according to ISO 4288, with measuring length 17.5 mm and cut-off 0.8 mm with a perthometer tip of 2 μm radius. The Pt represents the maximal difference between the peaks and grooves resulting from a slicing process (see examples of preparation). The Volume resistivity is measured according to ISO 3915. The Surface resistivity is measured according to DIN EN 61340-2-3 at 10V. The carbon black content in the UHMW-PE foil is determined in wt % using Thermo Gravic Analysis.

Figure 4C:
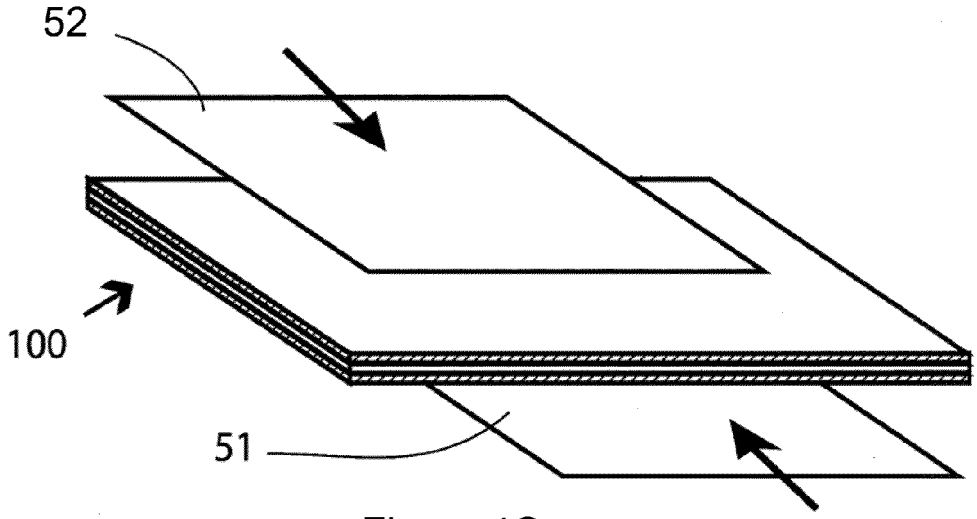
FIG. 4C shows a schematic operation of the heat exchange laminate in a printing system.

FIG. 4C shows a schematic operation of the heat exchange laminate in a printing system. The heat exchange laminate 100 is placed along the media transport path between the print media supply unit and the print engine. As depicted, a cold print media 51 is fed in one direction from the supply unit towards the print engine and on the opposite side of the heat exchange laminate a hot print media 52 is fed from the engine towards a delivery station. The hot print media 52 donates a portion of its thermal energy to the cold print media 51 via the heat exchange laminate 100.

Alternatively the streams of print media may be directed in the same direction on both sides of the heat exchange laminate.

The heat exchange laminate including the contact layers 100, 101 is electrically grounded by providing an electrical connection to the supporting frame of the heat exchange laminate unit. The electrical connection can be made by contacting an electrical conducting brush, having hairs comprising a carbon compound, on the outer surface of the contact layers 100, 101 and/or the base layer 75. In order to directly contact the base layer 75 a portion of the base layer 77 (Shown in FIG. 4A) may be uncoated by at least one of the contact layers 100, 101.

During a sliding contact between a surface of the print media and a contact surface of the heat exchange laminate 28 a tribo-electric charge may be formed on both the print media and the heat exchange laminate 28. The charge formed on the contact surface of the print media is opposite to the charge formed on the surface of the heat exchange laminate 28. As a result a disturbing electrical attracting force is generated between the print media and the heat exchange laminate, thereby increasing the friction of the print media during transport through the heat exchange unit. A pulling force for transporting the print medium through the heat exchange unit provides a direct measure of the friction of the print media. The pulling force is measured at drawing pinch 22 or drawing pinch 32 (FIG. 3) by pulling the print media through the heat exchange unit 20 at a fixed transport velocity, while determining the transport force at a transport pinch 32 or transport pinch 22. The generated tribo-electric charge on the surface of the heat exchange laminate is measured by using an apparent surface voltage detector having a spot diameter of 3-5 mm.

In Table 2 the increase of the pulling force and the apparent surface voltage is shown for a number of heat exchange laminates, wherein the contact layer of the heat exchange laminate has been varied.

TABLE 2 apparent surface forces and pulling force of various UHMW-PE contact layers.

| Folie nr./type | Apparent surface voltage [V] | Increase of Pulling force ΔF [N] |
|---|---|---|
| No. 440B | −48 V | >1.5 |
| PG5415B | −11 V | n.a. |
| PG5400BC-1 | −0.2 V to −6 V | <0.3 |
| PG5400BC-2 | −3 V | n.a. |
| PG5422BC | −4 V | n.a. |
| PG5426BC | −1 V | −0.3 until +0.1 |

Remark: PG5400BC-1 contains 4 wt % Carbon Black and PG5400BC-2 contains 3.2 wt % Carbon Black.

The apparent surface voltage was measured after transporting a number of Oce Black Label plain paper sheets at a transport speed of 120 prints per minute through the heat exchange unit. The apparent surface voltage builds up on the contact layer for each sheet. A maximum for the apparent surface voltage can be reached in about 150 sheets for slow discharging contact layers. For each contact layer the maximum apparent surface voltage was measurement after transporting 200 sheets A4 Black label plain paper through the heat exchange unit. As the tribo-electric charge remains substantially permanent on the contact layer the measurement can be performed after the paper transport.

In the pulling force test the pressure on the heat exchange laminate perpendicular to the surface is about 50 Pa. The pulling force measured is nominal about 1.0 N (between 0.9 N and 1.2 N) in case the contact layer used freshly and is not charged by tribo-electric charging. The increase of the pulling force is determined after transporting 8000 sheets of A4 Black Label plain paper at a transport speed of 120 prints per minute through the heat exchange unit. After discharging the heat exchange laminate the pulling force substantially returns to the original nominal pulling force of about 1.0 N. This indicates that the build up of the tribo-electric charge on the contact layer is correlated to the increase of the pulling force.

The order of performance of the contact layers in both apparent surface voltage and stability of pulling force is PG5426BC>PG5400BC>>Nitto Denko (No.440B).

For PG5400BC no significant difference was observed in apparent surface voltage for the two tested amounts of carbon black (3.2 wt % and 4.0 wt %).

The PG5426BC contact layer may even show a small decrease of the pulling force after the paper load with respect to an initial pulling force, which is probably due to a polishing of the outer surface of the contact layer.

From Table 1 and Table 2 it can be seen that a tribo-electric charging of the heat exchange laminate 28 or a pulling force of the print media do not correlate with a volume resistivity or a surface resistivity of the contact layer used in the heat exchange laminate.

Figure 5:
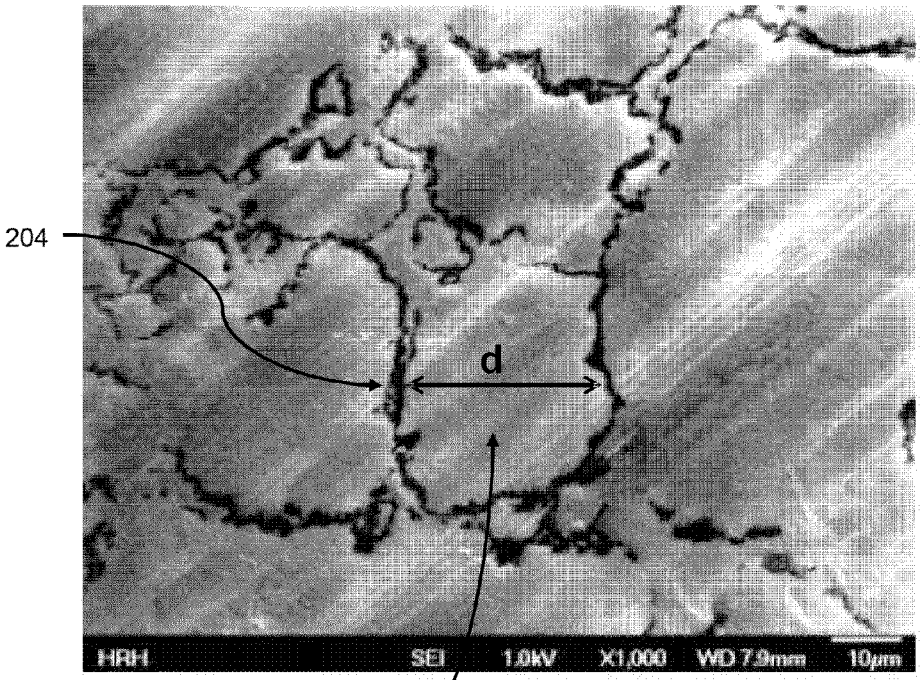
FIG. 5 shows an illustration of polyethylene domains at the surface of the contact layer according to the invention.

In order to investigate the difference in performance of the heat exchange laminate 28, the surface of the contact layers is inspected by using Scanning Electron Microscopy (SEM). By using SEM domains of polyethylene 202 can be observed at the surface (as is shown in FIG. 5), which domains 202 are enclosed by coatings of carbon black 204.

The size of the domains 202 can be determined using SEM and statistical analyses of the obtained images. The size of the domains of PE 202 can be expressed in an average domain diameter d. The PE domain properties of the contact layers are shown in Table 3:

TABLE 3 domains of PE at the surface of PE contact layer

| Contact layer | Domain size d of PE [μm] | Electron charging in SEM [5 kV] |
|---|---|---|
| No. 440B | 60-120 | High |
| PG5400BC | 30-50 | Medium |
| PG5426BC | 10-30 | Low |

By increasing the electron beam voltage to at least 5 kV during SEM scanning a negative charging of the PE domains can be visualised by lightening of the PE domain area. It is seen that the larger domains of PE in the Nitto Denko (No.440B) have a high degree of negative charging, while the domains of PG5400BC have a medium degree of negative charging and the domains of PG5426BC have a low degree of negative charging.

EXAMPLES

Preparation of Conductive UHMW-PE Foil

For preparing a conductive UHMW-PE foil 101, 102 first a mixture is made of polyethylene particles, having a small particle size, and of carbon black particles, having a small particle size and a high specific surface area (i.e. larger than 100 square meter per gram using the BET equation).

| Property | Method |
|---|---|
| Molecular weight | ASTM D-4020 |
| Average Particle Size | Accusizer, Volume average |

An Accusizer CW780, provided by PSS-NICOMP, is used to determine the average particle size of the polyethylene powders. The particle size measurement may be based on a combination of laser diffraction by the particles and light extinction by the particles. The particle size measurements of the examples according to the invention are performed by determining the light extinction by the particles. A test sample is prepared by dispersing 0.5 g of the polyethylene powder in 200 ml water using about 1.5 wt % of detergent. About 1 ml of the test sample is measured in the Accusizer CW780.

Suitable carbon black particles are for example PRINTEX L, PRINTEX L6 provided by Orion Engineered Carbons GmbH, CONDUCTEX SC, CONDUCTEX 975 provided by Columbian Chemicals and VULCAN XC-72 provided by Cabot Corporation.

The polyethylene particles and the carbon black are mixed and processed such that small domains of polyethylene are formed surrounded by the carbon black. The carbon black provides charge conducting pathways along the surface of the foil 101,102 and throughout the bulk of the foil 101,102. As a result the surface conductivity and the volume conductivity of the foil 101,102 are enhanced. In order to achieve small domains of polyethylene any agglomerates of polyethylene particles can be broken during pre-processing of the polyethylene particles or during the mixing process of the polyethylene particles and the carbon black particles. Furthermore the mixture of the polyethylene particles and the carbon black particles can be sieved over a screen in order to remove a fraction of larger particles. Preferably a screen is used in order to remove particles or agglomerates of particles having a particle size larger than 100 microns.

In a sintering step the mixture of the polyethylene particles and the carbon black particles is thermally treated in a mould up to a temperature higher than 150 degrees Centigrade, more preferably up to a temperature higher than 210 degrees Centigrade. During the sintering step a mould part is formed which comprises polyethylene domains, which are enclosed by the carbon black. The conductive UHMW-PE foil is prepared by slicing layers from the mould part, thereby providing the contact layers for the heat exchange laminate having a suitable thickness.

The recipes for preparation of several PE foils are shown in Table 4.

TABLE 4 examples of prepared conductive UHMWPE foils

| PE-foil | PE powder | $M_w \times 10^6$ [g/mol] | Particle size [micron] | CB powder | Amount CB [wt %] | PE domain size [um] |
|---|---|---|---|---|---|---|
| Example 1 | GUR4150-3 | 9.2 | 60 | Printex L6 | 3.2 | 30-50 |
| Example 2 | GUR4150-3 | 9.2 | 60 | Printex L6 | 4.0 | 30-50 |
| Example 3 | GUR2126 | 4.5 | 30 | Printex L6 | 6.5 | 10-30 |

Figure 6:
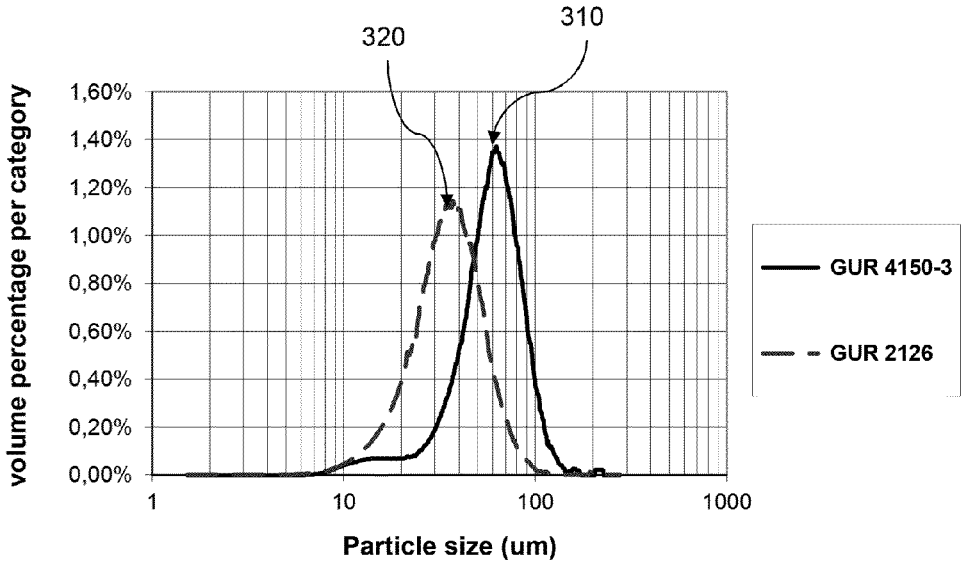
FIG. 6 shows a particle size distribution of several polyethylene powders for preparing the contact layer.

Suitable polyethylene particles are for example GUR 4120, GUR 4150-3, GUR 2122, GUR 2126 all provided by Ticona GmbH, MIPELON XM-220, MIPELON XM-221 provided by Mitsui Chemical America, HB312CM, HB320CM provided by Montell. The polyethylene powders were analysed for various properties according to the following procedures:

By comparing example 1 and 2 it is found that an increase of the amount of Carbon Black from 3.2 wt % to 4.0 wt % does not change the polyethylene domain size. In comparing the particle size distribution of GUR 4150-3 and GUR 2126 (shown in FIG. 6) we see that the volume average particle size distribution of GUR 4150-3 (measurement 310) has a peak around 60 micron and has a tail of larger particles which are larger than 100 microns. The volume average particle size distribution of the GUR 2126 (measurement 320) has a peak around 30 micron and a tail of larger particles up to about 100 micron. The size of polyethylene domains at the surface of the resulting PE-foils is determined in a similar way as the size of domains shown in Table 3 and FIG. 5. In Table 4 can be seen that the example 3 of GUR2126, which has smaller polyethylene particles with respect to the examples 1 and 2 of GUR4150-3, leads to smaller domains of polyethylene in the PE-foils.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A heat exchange laminate for use as a heat exchange member in a heat exchange unit, comprising a base layer extending substantially planar, said base layer being bilaterally coated with an electrically conductive contact layer, wherein the electrically conductive contact layer comprises a high molecular weight polyethylene and a carbon black, and wherein the carbon black is provided in an amount of at least 3 wt % based on the total weight of the contact layer, wherein the carbon black encloses polyethylene domains.

2. The heat exchange laminate according to claim 1, wherein the polyethylene domains have a number average domain size of at most 50 microns.

3. The heat exchange laminate according to claim 1, wherein the polyethylene domains of the contact layer are provided by a polyethylene powder having a volume average particle size of about 60 microns or smaller.

4. The heat exchange laminate according to claim 1, wherein the polyethylene domains in the contact layer are provided by a polyethylene powder having a volume average particle size of about 30 microns or smaller.

5. The heat exchange laminate according to claim 1, wherein the polyethylene has a weight average molecular weight $M_w$ of at least $4\times10^6$ g/mol.

6. The heat exchange laminate according to claim 1, wherein the electrically conductive contact layer has a thickness of at most 200 microns.

7. The heat exchange laminate according to claim 1, wherein the base layer is a metallic sheet.

8. The heat exchange laminate according to claim 7, wherein the metallic sheet comprises an iron-nickel-alloy.

9. The heat exchange laminate according to claim 1, wherein the base layer has a linear thermal expansion coefficient $\alpha$ smaller than $2\times10^{-6}$ m/m·K.

10. A heat exchange unit, comprising:

the heat exchange laminate according to claim 1;

wherein the heat exchange unit is configured for providing a sliding contact between an energy donating element and a first contact layer of the heat exchange laminate and providing a sliding contact between an energy receiving element and a second contact layer of the heat exchange laminate.

11. The heat exchange unit according to claim 10, wherein the heat exchange unit is a counter-flow heat exchange unit.

12. The heat exchange unit according to claim 10, wherein the heat exchange unit is provided in a printing system for cooling a print media from a print engine and heating a print media towards a print engine, wherein each of the print media is in moving contact with one of the first and second contact layers of the heat exchange laminate.

13. The heat exchange laminate according to claim 1, wherein the carbon black is provided in an amount of at least 4 wt % based on the total weight of the contact layer.

14. The heat exchange laminate according to claim 1, wherein the polyethylene has a weight average molecular weight $M_w$ of at least $9\times10^6$ g/mol.

15. A heat exchange unit, comprising a heat exchange region, a first print media transport path configured for transporting in operation a first print medium from a print media supply through the heat exchange region to a print engine and a second print media transport path configured for transporting in operation a second print medium from the print engine through the heat exchange region, the heat exchange unit further comprising a stationary heat exchange member, having a first side facing said first print media transport path and a second opposite side facing said second print media transport path, in operation the second print medium is at an elevated temperature with respect to the first print medium and wherein the first and second print medium have a heat exchange contact in the heat exchange region, wherein the stationary heat exchange member is a heat exchange laminate according to claim 1.

16. A printing system comprising a print media supply, a print engine for applying marking material to a print media and a heat exchange unit according to claim 15.

17. A heat exchange laminate for use as a heat exchange member in a heat exchange unit, comprising a base layer extending substantially planar, said base layer being bilaterally coated with an electrically conductive contact layer, wherein the electrically conductive contact layer comprises a high molecular weight polyethylene and a carbon black, and wherein the polyethylene has a weight average molecular weight $M_w$ of at least $5\times10^5$ g/mol.

18. The heat exchange laminate according to claim 17, wherein the polyethylene has a weight average molecular weight $M_w$ of at least $4\times10^6$ g/mol.

19. A heat exchange laminate for use as a heat exchange member in a heat exchange unit, comprising a base layer extending substantially planar, said base layer being bilaterally coated with an electrically conductive contact layer, wherein the electrically conductive contact layer comprises a high molecular weight polyethylene and a carbon black, and wherein the electrically conductive contact layer has a thickness of at most 200 microns.

* * * * *